US005432349A

United States Patent [19]

Wood et al.

[11] Patent Number: 5,432,349

[45] Date of Patent: Jul. 11, 1995

[54] FOURIER TRANSFORM MICROSCOPE FOR X-RAY AND/OR GAMMA-RAY IMAGING

[75] Inventors: Kent S. Wood, Chevy Chase; Uri Feldman, Columbia, both of Md.

[73] Assignee: The United State of America as represented by the Secretary of the Navy, Washington, D.C.

[21] Appl. No.: 31,410

[22] Filed: Mar. 15, 1993

[51] Int. Cl.[6] ..... G21K 7/00

[52] U.S. Cl. ..... 250/336.01; 378/43; 378/149

[58] Field of Search ..... 378/43, 149, 154, 155; 250/363.10, 336.1

[56] References Cited

U.S. PATENT DOCUMENTS

| | | | |
|---|---|---|---|
| 3,580,655 | 5/1971 | Leith et al. . | |
| 3,981,562 | 9/1976 | Anthon | 356/71 |
| 4,096,391 | 6/1978 | Barnes | 378/155 |
| 4,288,697 | 9/1981 | Albert | 378/149 |
| 4,674,824 | 6/1987 | Goodman et al. . | |
| 4,721,362 | 1/1988 | Brody et al. . | |
| 4,843,631 | 6/1989 | Steinpincher et al. . | |
| 4,852,955 | 8/1989 | Doyle et al. . | |
| 4,870,674 | 9/1989 | Schmahl et al. | 378/43 |
| 4,891,829 | 1/1990 | Deckman et al. | 378/4 |
| 4,951,305 | 8/1990 | Moore et al. | 378/154 |
| 4,955,974 | 9/1990 | Rhodes et al. | 378/36 |
| 5,134,288 | 7/1992 | Van Dijck | 250/307 |
| 5,144,129 | 9/1992 | Kobayashi et al. | 250/307 |
| 5,233,193 | 8/1993 | Arakawa | 378/155 |

OTHER PUBLICATIONS

Oda, "High-Resolution X-ray Collimator with Broad Field of View for Astronomical Use", Applied Optics, 4 (1), Jan. 1965, p. 143.

T. Kosugi et al., The Hard X-Ray Telescope (HXT) for the Solar-A Mission, Solar Physics, 136, 17 (1991).

K. S. Wood et al., A Fourier Transform Microscope for X-Ray Imanging, Rev. Sci. Instrum. 63(10) (Oct., 1992); presented Mar. 18, 1992.

H. Brandt et al., The Modulation Collimator in X-Ray Astronomy, 8 Space Science Reviews, 471-06 (1968).

*Primary Examiner*—Carolyn E. Fields

*Attorney, Agent, or Firm*—Edward F. Miles; Thomas E. McDonnell

[57] ABSTRACT

A Fourier transform microscope for use in imaging a source of x-ray and/or gamma-ray radiation includes first and second grids arranged in proximity to the source. The first grid includes an arrangement of first subgrids elements with a first predetermined number n of approximately parallel, equally-spaced linear first ribs which are opaque to the radiation of interest, and first radiation-transparent regions which are arranged in alternation with the first ribs. The second grid includes an arrangement of second subgrids elements which are larger than the first subgrids elements, and which have a common field of view with corresponding first subgrid elements. Each second subgrid element has a second predetermined number n+m of approximately parallel, equally-spaced linear second ribs which are opaque to the radiation of interest, and second radiation-transparent regions which alternate with the second ribs. Each first subgrid element and its corresponding second subgrid element is termed a 'subgrid system'. Each subgrid system can be used to derive an amplitude and phase of an associated Fourier component. A position-sensitive detector detects a Moiré or fringe pattern from wach subgrid system and generates a signal indicative of the radiation intensity distribution image of the source in spatial frequency domain which can be converted into a radiation intensity distribution image of the source in spatial domain using a Fourier transform.

14 Claims, 7 Drawing Sheets

FOURIER TRANSFORM MICROSCOPE FOR X-RAY AND/OR GAMMA-RAY IMAGING

BACKGROUND OF THE INVENTION

1. Field of the Invention

This invention is directed to an apparatus and method for imaging a radiation intensity distribution of a source of x-ray and/or gamma-ray radiation.

2. Description of the Related Art

Several conventional devices and techniques using reflective optics (e.g., mirrors) or Fresnel zone plates exist for x-ray microscopy at radiation energies below two kilo-electron volts (keV). At radiation energies above two keV, the performance of x-ray reflective optics devices and techniques becomes poor because mirror reflectivity is relatively small for photons at these energies, and hence the length of the optical surfaces required to achieve grazing incidence reflection increases prohibitively. As a result, most reflective optics systems are unable to obtain spatial resolution below several tens of micrometers at radiation energies above two keV. The performance of devices and techniques using Fresnel zone plates also degenerates at relatively high radiation energies (i.e., above two keV) because the required thickness of a radiation-opaque material forming such Fresnel zone plates, increases at higher radiation energies while the required spacing of the radiation-opaque material decreases. Therefore, the Fresnel zone plates are required to have relatively thick regions of radiation-opaque material which are spaced relatively close together, a structure which is difficult to manufacture. Also, Fresnel zone plates must be designed for a relatively narrow range of radiation energies, a requirement which can limit the use of devices and techniques which employ Fresnel zone plates.

Other conceivable devices and techniques for imaging a source of x-ray or gamma-ray radiation might use coded aperture imaging in which a single mask has multiple apertures or pinholes placed between the source and a position-sensitive radiation detector. The detector records a transform of the source image which can be inverse-transformed to reconstruct an image of the radiation intensity distribution of the source. However, this method will not provide imaging at scales much finer than the finest scale measurable with the position-sensitive radiation detector, so that the position resolution of the source is typically limited to several tens of micrometers.

Other conventional devices and techniques for imaging a source of x-ray or gamma-ray radiation have been applied to radio-astronomy applications and use interferometers which include pairs of antennae along various base lines which are used to extract Fourier components. Also, with respect to x-ray radiation, modulation collimators and other designs utilizing arrangements of grids have been employed. However, these telescope arrangements are only suitable for applications in which the source to be imaged is relatively distant from the telescope arrangement. Accordingly, these telescope arrangements are not suitable for an x-ray or gamma-ray radiation microscope.

To summarize, the devices and techniques described above are not suitable for microscope applications producing relatively fine spatial resolution (e.g., as low as a few microns) for radiation energies above about one-tenth keV. Therefore, these conventional devices and techniques fail to meet the demands of applications such as inertial confinement fusion (ICF) experiments in which a target compressed to less than 100 microns in size radiates copious x-rays above two keV for a short time. Also, these conventional devices and techniques are inadequate for medical applications requiring relatively fine spatial resolution of sources which emit radiation at energies above two keV.

SUMMARY OF THE INVENTION

An object of the present invention is to provide an apparatus and/or method for imaging a source of relatively high energy radiation with a relatively fine spatial resolution.

Another object of the present invention is to provide an apparatus and/or method for generating a magnified image of a source of relatively high energy radiation with a relatively fine spatial resolution.

Another object of the present invention is to provide an apparatus and/or method for imaging a source of x-ray and/or gamma-ray radiation with a relatively fine spatial resolution as low as a few microns.

Another object of the present invention is to provide an apparatus and/or method for generating a magnified image of a source radiating x-ray and/or gamma-ray radiation with a relatively fine spatial resolution using a position-sensitive detector with sensing elements which do not resolve more finely than a few hundred microns.

Another object of the present invention is to provide an apparatus and/or method for imaging a source radiating x-ray and/or gamma-ray radiation in an ICF experiment with a relatively fine spatial resolution as low as a few microns.

Another object of the present invention is to provide an apparatus and/or method for imaging a source radiating x-ray and/or gamma-ray radiation with a relatively fine spatial resolution as low as a few microns in medical applications.

Another object of the present invention is to provide an apparatus and/or method for generating an image of a relatively small source of x-ray and/or gamma-ray with a relatively fine spatial resolution using a Fourier transform.

The above objects are obtained by the apparatus and method herein disclosed. According to the present invention, there is provided an apparatus for imaging a source of radiation by deriving an image of the radiation intensity distribution of the source in spatial frequency domain, which can be converted using an inverse-Fourier transform into an image in spatial domain. To derive the image in spatial frequency domain, the apparatus uses a first grid arranged in proximity to the source, and a second grid arranged in proximity to the first grid. The first grid has an arrangement of first subgrid elements. Each first subgrid element has an arrangement of a first predetermined number n of approximately equally-spaced, parallel or slightly divergent linear first ribs which are opaque to the radiation of interest. In alternation with the first ribs, first radiation-transparent regions are provided which are transparent to the radiation of interest. The first ribs of each first subgrid element have a particular spacing and orientation relative to reference axes in the plane of the first grid.

Approximately speaking, the second grid is an expanded version of the first grid. The second grid has second subgrid elements which have a common field of view with corresponding first subgrid elements. However, each second subgrid element has an arrangement of a second predetermined number n+m (rather than merely the first predetermined number n) of approximately equally-spaced, parallel or slightly divergent linear second ribs which are opaque to the radiation of interest. The second ribs of a given second subgrid element have the same orientation as the first ribs of the corresponding first subgrid element (a first subgrid element and its corresponding second subgrid element are termed a 'subgrid system'). Photons of the radiation of interest generated by the source, pass through a given subgrid system and generate a radiation intensity distribution termed a 'Moiré' or 'fringe pattern' for each subgrid system. The Moiré or fringe pattern has m maxima (i.e., peak amplitudes) which occur at a particular phase relative to a reference system provided for each subgrid system. Because the spatial frequency of the Fourier component measured by a given subgrid system is predetermined by the spacing of the first ribs of the first subgrid element of that subgrid system, and because the orientation of each subgrid system is also predetermined relative to the reference axes, the Fourier component for each subgrid system is completely defined by measuring the amplitude and phase of the Moiré or fringe pattern generated by each subgrid system. These measurements can be performed using a position-sensitive detector such as a photographic film or an array of photodiodes, for example.

The array of amplitudes, phases, spatial frequencies and orientations of the Fourier components of all subgrid systems in the apparatus are collectively referred to as the image of the radiation intensity distribution of the source in spatial frequency domain. Using a Fourier transform, the image in spatial frequency domain can be converted to an image in spatial domain by employing a processor. If the position-sensitive detector is realized so that it has an analog output (e.g., as would be the case with a photographic film), the analog output is converted into a digital signal using a digitizer, and the digital signal is provided to the processor coupled to the digitizer. Otherwise, the position-sensitive detector can be coupled directly to the processor, so that the digital signal is provided directly thereto. In any case, using a control program stored in a memory coupled to the processor, the processor can perform a Fourier transform on the digital signal of the image in spatial frequency domain to generate a digital signal of the image in spatial domain. The processor can be coupled to a display unit which displays either or both of the image in spatial frequency domain or the image in spatial domain derived from the respective digital signals.

These together with other objects and advantages, which will become subsequently apparent, reside in the details of the construction and operation as more fully hereinafter described and claimed, reference being had to the accompanying drawings, forming a part hereof, wherein like numerals refer to like parts throughout.

DESCRIPTION OF THE PREFERRED EMBODIMENTS

Figure 1:
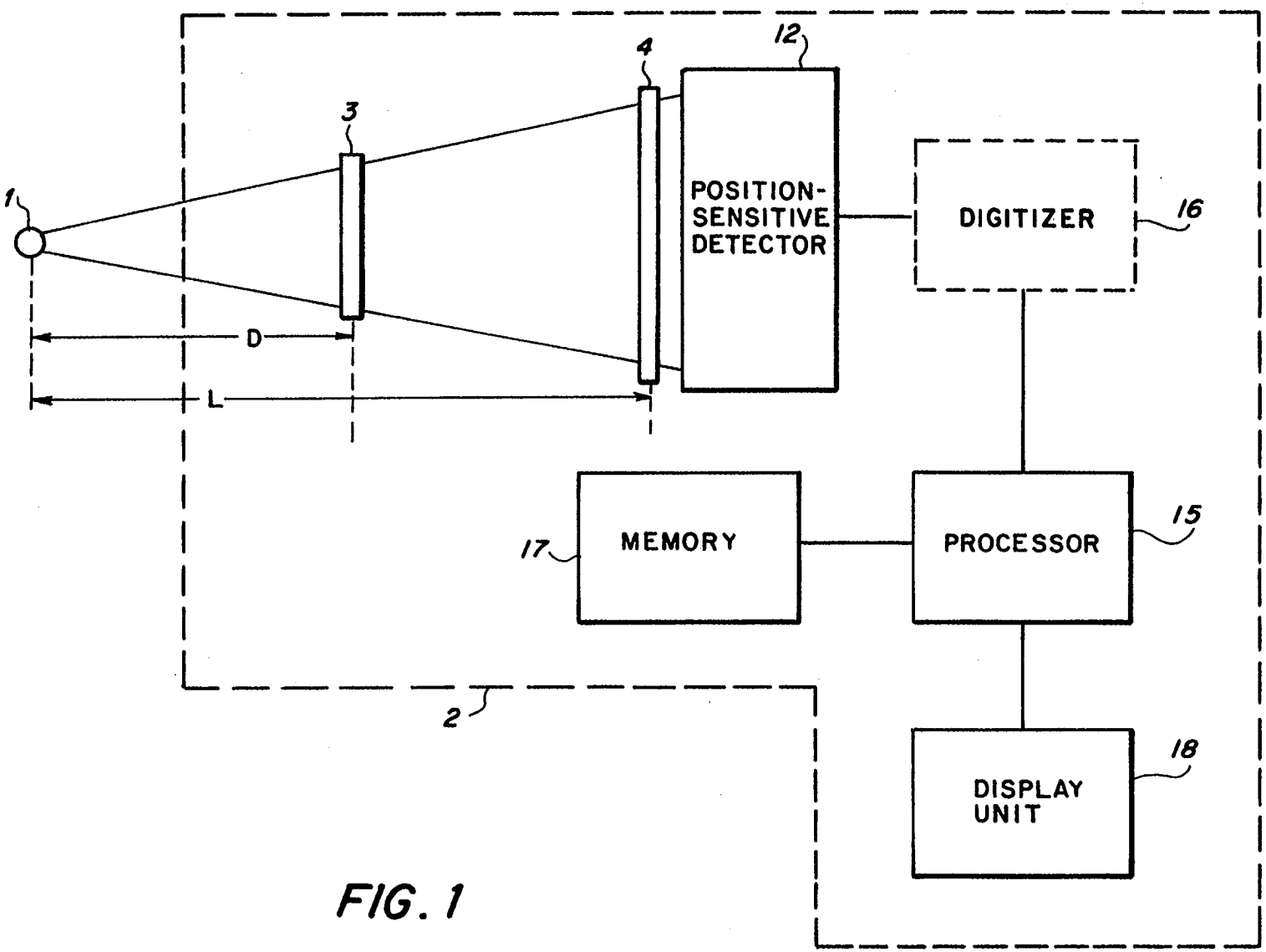
FIG. 1 is an apparatus in accordance with the claimed invention.

In FIG. 1, a source 1 emits x-ray and/or gamma-ray radiation. A Fourier transform microscope 2 is arranged in proximity to the source 1 and receives at least a portion of the x-ray and/or gamma-ray radiation therefrom. Although the Fourier transform microscope 2 of the claimed invention is particularly effective for imaging the radiation intensity distribution of relatively small, nearby (less than ten meters distant) sources (e.g., on the order of a few tens of microns to several hundreds of microns) emitting photons at radiation energies (as low as one-tenth keV, but typically about two keV or more) with relatively good spatial resolution (e.g., as fine as a few microns), the Fourier transform microscope 2 can effectively image a source 1 with other dimensions and radiation energies. In addition, technological advancements in such fields as mask lithography should enable the Fourier transform microscope 2 of the claimed invention to attain increasingly better spatial resolution for increasingly higher radiation energies in the future, so it is not desired to limit the claimed invention to the particular embodiments described below. However, at present, there are several specific applications in which conventional devices and techniques cannot attain imaging of the radiation intensity distribution of a source 1 which is relatively small in size and which emits photons at radiation energies above two keV. For example, for applications in which the source 1 is a target in an ICF experiment, or a source of radiation used in some medical applications, the Fourier transform microscope 2 of the claimed invention is particularly effective, whereas conventional devices and techniques are not.

The Fourier transform microscope 2 functions to obtain an image of the radiation intensity distribution of the source 1 in spatial frequency domain, which can be converted using an inverse-Fourier transform into an image in spatial domain. To obtain the image in spatial frequency domain, the Fourier transform microscope 1 uses a first grid 3 arranged in proximity to the source 1, and a second grid 4 arranged in proximity to the first grid 3. The first grid 3 and the second grid 4 are arranged at distances D and L, respectively, from the source 1, and receive at least a portion of the radiation emitted by the source 1. The first grid 3 and the second grid 4 are aligned such that the first grid 3 approximately defines a plane which is approximately parallel to a plane containing the source 1, and the second grid 4 approximately defines a plane which is parallel to both the source plane and the plane defined by the second grid 4.

Figure 2:
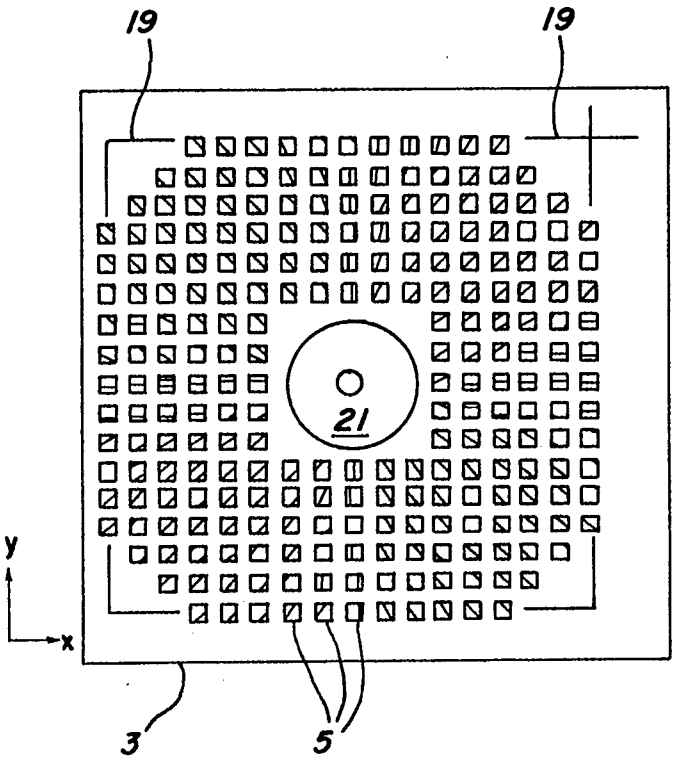
FIG. 2 is a first grid of the apparatus of the claimed invention.

In FIG. 2, the first grid 3 includes an arrangement of first subgrid elements 5. For simplicity, only three of the first subgrid elements 5 are indicated by the numeral 5 in FIG. 2, although this numeral refers to all of the first subgrid elements 5. Also, although the first subgrid elements 5 have square configurations in FIG. 2, the first subgrid elements 5 can function effectively with other configurations.

Figure 3:
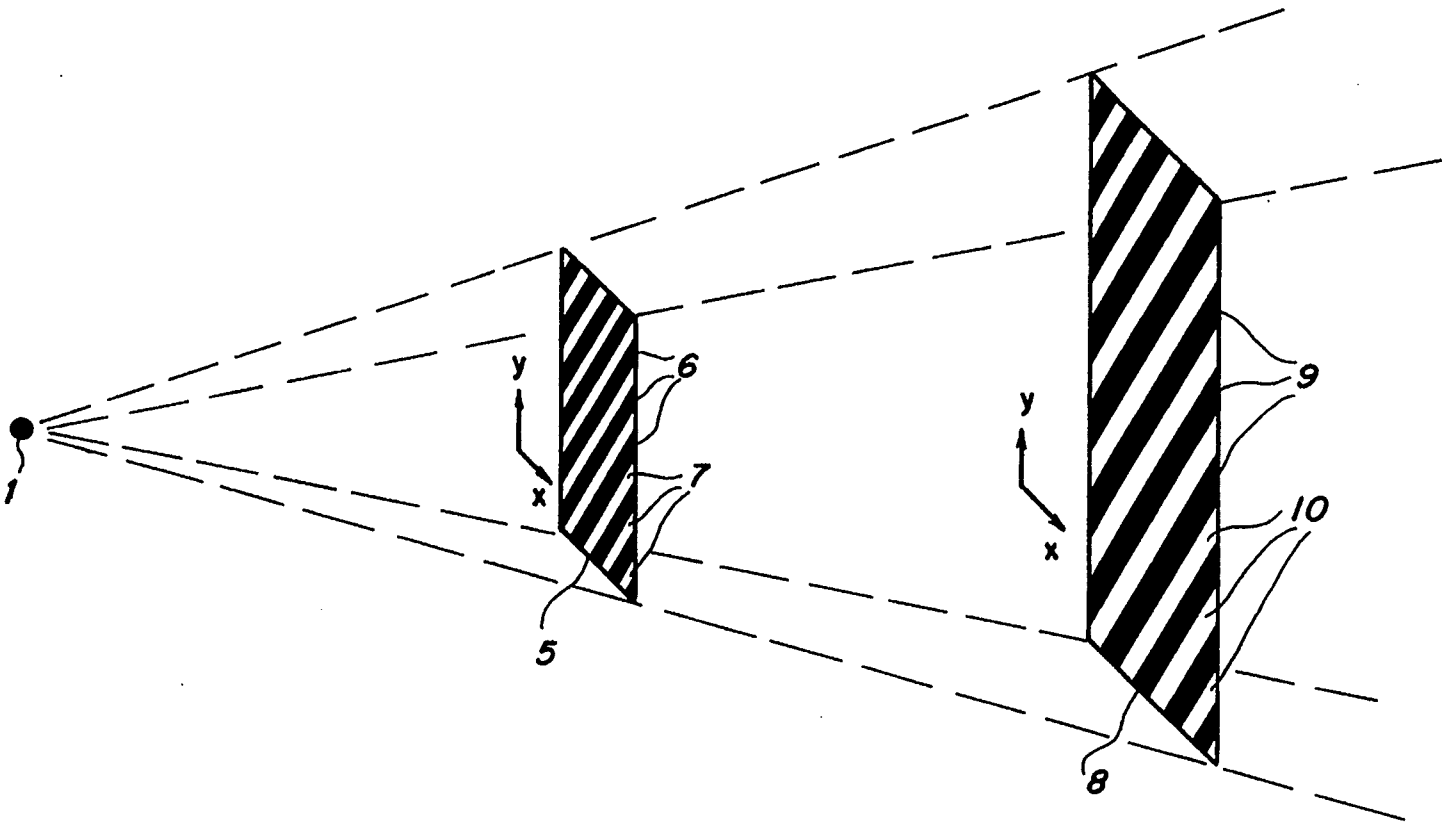
FIG. 3 is a subgrid system of the apparatus of the claimed invention.

As best seen in FIG. 3 in which only a particular one of the first subgrid elements 5 is illustrated, each first subgrid element 5 has an arrangement of a first predetermined number n of first ribs 6 which are approximately equally-spaced, parallel or slightly divergent linear regions which are opaque to the radiation of interest from the source 1. In FIG. 2, only one first rib 6 is indicated in each first subgrid element 5, but it should be understood that there are typically several first ribs 6 in each first subgrid element 5. Preferably, the first ribs 6 are arranged, as nearly as practicable, along radial lines emanating from a center of the first grid 3 to reduce vignetting. However, because the first ribs 6 within any subgrid element are also required to be approximately parallel, only a central one of the first ribs 6 can be arranged along a radial line from the center of the first grid 3: the other first ribs 6 will be slightly skewed from a position along a radial line from the center of the first grid 3. However, if vignetting poses a significant problem, the first ribs 6 can be made slightly divergent to more closely coincide with radial lines emanating from the center of the first grid 3 although some accuracy in the spatial frequency of the radiation of interest measured with the divergent first ribs 6 is sacrificed if the first ribs 6 are so arranged.

In alternation with the first ribs 6, first radiation-transparent regions 7 are provided which are transparent to the radiation of interest from the source 1. Preferably, the first radiation-transparent regions 7 are transmissive to at least 90% of the incident radiation, although other transmissivities can be used. The first ribs 6 are formed of a substance with a thickness which is sufficient to attenuate the intensity of radiation passing therethrough to preferably at least 40% of its incident intensity, although other attenuation percentages can be used. The substance used to form the first ribs 6 should have relatively high density to absorb radiation effectively, and also should be capable of being formed into relatively precise configurations. For example, the first ribs 6 can be formed of gold, tantalum or tungsten. The required thickness of the substance used to form the first ribs 6 is determined by the desired radiation attenuation and the substance used to form the first ribs 6, and can be determined using absorption coefficient versus incident radiation energy graphs which are widely-known and used by those of ordinary skill in the art. As an example, the first ribs 6 can be formed of tungsten with a thickness of 4 microns, which attenuates incident radiation of 7.3 keV to about 20% of its incident intensity.

Although the first ribs 6 of each of the first subgrid elements 5 have spacings which are approximately constant within any one of the first subgrid elements 5, the spacings of the first ribs 6 can vary relative to the first ribs 6 of other first subgrid elements 5. Specifically, the spacing of the first ribs 6 of the first subgrid elements 5 can range from roughly twice the desired spatial resolution of the image in spatial domain (a manifestation of the Nyquist criterion), to roughly the full size of the source 1 or greater. However, to avoid an occurence of of diffraction phenomenon, the spacings of the first ribs 6 are predetermined to satisfy the relationship $d_1^2 > \lambda \cdot L/2$, where $d_1$ is the spacing between the first ribs 6, $\lambda$ is the longest wavelength of the radiation of interest, and L is the distance from the source 1 to the second grid 4.

In addition, the first ribs 6 of each first subgrid element 5 have an angular orientation relative to a reference coordinate system such as that defined by axes x and y in the plane of the first grid 3. For example, the first ribs 6 of the first subgrid element 5 of FIG. 3 have an orientation of about 60 degrees counterclockwise relative to the x axis.

Accordingly, the first ribs 6 of each of the first subgrid elements 5 have a particular spacing (which defines a spatial frequency) and angular orientation which can be used to derive one Fourier component of an image of the radiation intensity distribution of the source 1 in spatial frequency domain. Specifically, the angular orientation and the spatial frequency of the first ribs 6 of a given first subgrid element 5, are equal to the spatial frequency and angular orientation, respectively, of the Fourier component derived from the given first subgrid element 5.

The first grid 3 can be manufactured in a variety of ways which will readily occur to those of ordinary skill in the art. For example, the first grid 3 can be manufactured with mask lithography techniques using a silicon substrate to form the first radiation-transparent regions 7 of each subgrid element 5, with patterned linear regions of tungsten, gold or tantalum formed on the silicon substrate, forming the first ribs 6 of each first subgrid element 5. In regions of the first grid 3 not used to form first subgrid elements 5, the silicon substrate is preferably formed to a thickness sufficient to produce opacity to the radiation of interest to avoid any deleterious affect upon radiation of interest passing through the first subgrid elements 5. This opacity to radiation in areas other than those occupied by the first subgrid elements 5 is preferred regardless of the material or technique used to form the first grid 3. While the first subgrid elements 5 are shown in FIG. 2 arranged in rows and columns, a slight stagger to the arrangement of the first subgrid elements 5 should be employed to avoid the formation of potential breakage lines in the silicon substrate. Alternatively, a different arrangement of the first subgrid elements 5 can be employed to avoid potential breakage lines. First subgrid elements 5 with spacings of the first ribs 6 as small as two microns can be obtained from the Center for Microelectronics, North Carolina ("MCNC"). Spacings of the first ribs 6 of ten microns or greater can be obtained from a variety of commercial sources. Regardless of the technique and structure used to produce the first grid 3, cumulative error in spacing of the first ribs 6 should be avoided.

Figure 4:
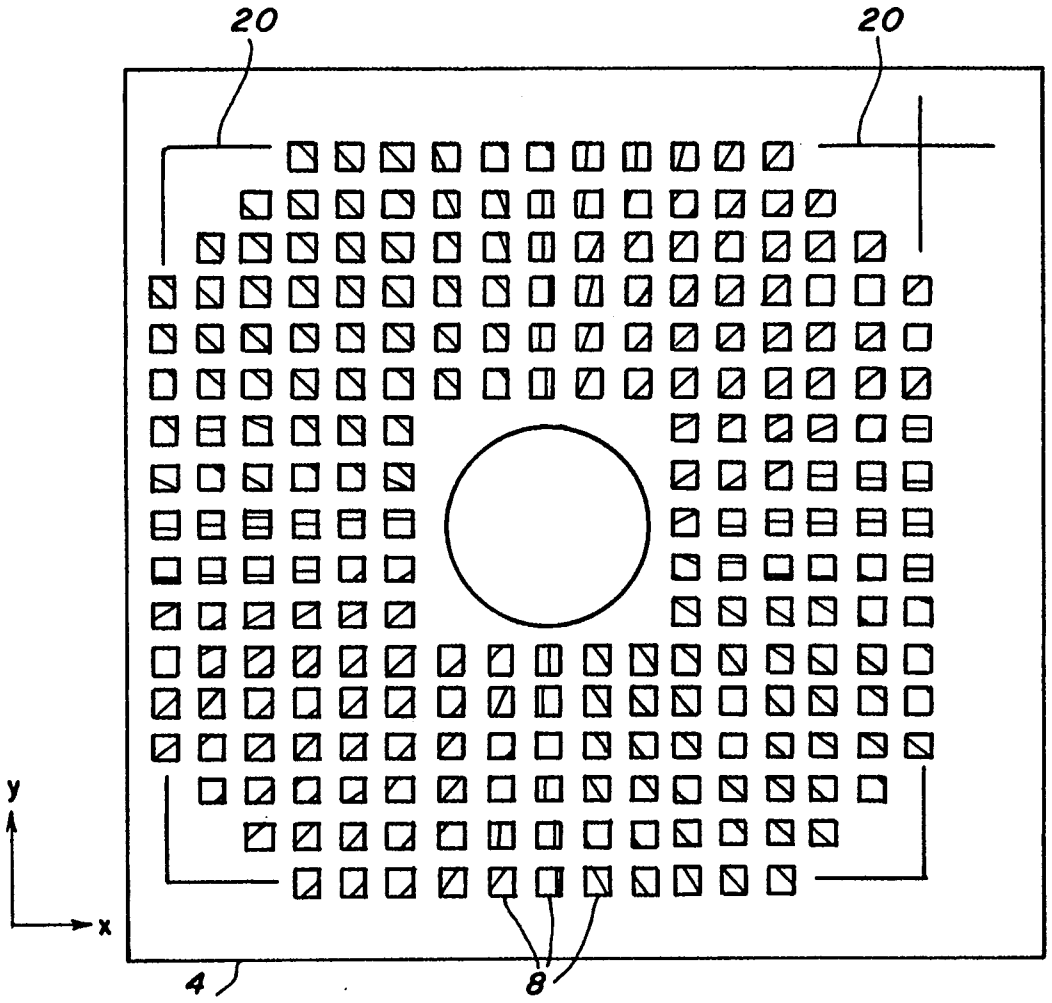
FIG. 4 is a second grid of the apparatus of the claimed invention.

To derive the image of the radiation intensity distribution of the source 1 in spatial frequency domain in applications in which the ability to detect quantities associated with Fourier components output by the first subgrid elements 5 is desired to be increased, the second grid 4 is required in addition to the first grid 3. Approximately speaking, the second grid 4 is an expanded version of the first grid 3, although the second grid 4 differs in a few significant aspects from the first grid 3. Referring to FIG. 4, the second grid 4 has an arrangement of second subgrid elements 8 which are arranged to correspond with the field of view of corresponding first subgrid elements 5 at a particular distance, D-L, from the first grid 3. In other words, as shown in FIG. 3, the photons which are incident to and pass through a given one of the first subgrid elements 5, are also incident upon the corresponding second subgrid element 8 at the distance D-L from the first grid 3, although these photons can be either absorbed or transmitted through the corresponding second subgrid element 8. Incidentally, a particular first subgrid element 5 and its corresponding second subgrid element 8 are termed a 'subgrid system'.

To provide regions which alternately absorb and transmit the radiation of interest, similarly to the structure of the first subgrid elements 5, each of the second subgrid elements 8 has second ribs 9 which are approximately equally-spaced, parallel or slightly divergent linear regions formed of a substance which is opaque to the radiation of interest. For simplicity, only three of the second ribs 9 are indicated in FIG. 3 although this indication applies equally well to the other second ribs 9 designated by the dark areas in FIG. 3. For practical reasons, (only one of the second ribs 9 is illustrated for each second subgrid element 8 but second subgrid element 8 typically has several second ribs 9. Further, although the second subgrid elements 5 have square configurations in FIG. 4, the second subgrid elements 8 can function effectively with other configurations.

As with the first ribs 6, the second ribs 9 are preferably arranged, as nearly as practicable, along radial lines emanating from a center of the first grid 3 to reduce vignetting. However, only a central one of the second ribs 9 can be arranged along a radial line from the center of the second grid 4. The other second ribs 9 will be slightly skewed from a position along a radial line from the center of the second grid 4 because the other second ribs 9 are approximately parallel to the central one of the second ribs 9. However, if vignetting poses a significant problem, the second ribs 6 can be made slightly divergent to more closely coincide with radial lines emanating from the center of the second grid 4 although accuracy of the spatial frequency measured with the divergent second ribs 6 is sacrificed with the second ribs 6 so arranged.

The second ribs 9 are approximately equally-spaced within a given one of the second subgrid elements 8, although the spacing of the second ribs 9 can vary relative to other second subgrid elements 8. The spacing of the second ribs 9 of the second subgrid elements 8 can range from roughly twice the desired spatial resolution of the image in spatial domain (a manifestation of the Nyquist criterion), to roughly the full size of the source 1 or greater. However, to avoid an occurence of diffraction, the spacings of the second ribs 9 are predetermined to satisfy the relationship $d_2^2 > \lambda \cdot L/2$, where $d_2$ is the spacing between the second ribs 9, $\lambda$ is the longest wavelength of the radiation of interest, and L is the distance from the source 1 to the second grid 4. In alternation with the second ribs 9, each of the second subgrids 8 has second radiation-transparent regions 10 which are transparent to the radiation of interest.

Preferably, the second radiation-transparent regions 10 are transmissive to at least 90% of the incident radiation, although other transmissivities can be used. The second ribs 9 are formed of a substance with a thickness which is sufficient to reduce the intensity of radiation passing therethrough to preferably at least 40% of its incident intensity, although other attenuation percentages can be used. The substance used to form the second ribs 9 should have relatively high density to absorb radiation effectively, and also should be capable of being formed into relatively precise configurations. For example, the second ribs 9 can be formed of gold, tantalum or tungsten. The required thickness of the substance used to form the second ribs 9 is determined by the desired radiation attenuation and the substance used to form the second ribs 9, and can be determined using absorption coefficient versus incident radiation energy graphs which are widely-known and used by those of ordinary skill in the art. As an example, the second ribs 9 can be formed of tungsten with a thickness of 4 microns, which attenuates incident radiation of 7.3 keV to about 20%.

The second grid 4 can be manufactured in a variety of ways which will readily occur to those of ordinary skill in the art. For example, as explained above with respect to the first grid 3, the second grid 4 can be manufactured with mask lithography techniques using a silicon substrate to form the second radiation-transparent regions 10 of each second subgrid element 8, with patterned linear regions of tungsten, gold or tantalum formed on the silicon substrate, forming the second ribs 9 of each second subgrid element 8. In regions of the second grid 4 not used to form second subgrid elements 8, the silicon substrate is preferably formed to a thickness sufficient to produce opacity to the radiation of interest to avoid any deleterious affect upon radiation of interest passing through the second subgrid elements 8. This opacity to radiation in areas other than those occupied by the second subgrid elements 8 is preferred regardless of the material or technique used to form the second grid 4. While the second subgrid elements 8 are shown in FIG. 2 arranged in rows and columns, a slight stagger to the arrangement of the second subgrid elements 8 should be employed to avoid the formation of breakage lines in the silicon substrate. Alternatively, a different arrangement of the second subgrid elements 8 can be employed. Second subgrid elements 8 with spacings of the second ribs 9 as small as two microns can be obtained from the Center for Microelectronics, North Carolina ("MCNC"). Spacings of the second ribs 9 of ten microns or greater can be obtained from a variety of commercial sources. Regardless of the technique and structure used to produce the second grid 4, cumulative error in spacing of the second ribs 9 should be avoided.

Although the angular orientation of the second ribs 9 of a given second subgrid element 8 is approximately the same as the orientation of the first ribs 6 of the corresponding first subgrid element 5 in a given subgrid system, the spacing (i.e., the spatial frequency) of the second ribs 9 of a given second subgrid element 8 varies from the spatial frequency of the first ribs 6 of the corresponding first subgrid element 5. One reason that the spatial frequency of the second ribs 9 of a given second subgrid element 8 varies from the spatial frequency of the first ribs 6 of the corresponding first subgrid element 5, is that the second subgrid element 8 is approximately a larger version of the first subgrid element 5 which results by projection of a point source of light in the source plane and approximately at the center of the first grid 3, through the first subgrid element 5 and onto the plane of the second grid 4. Accordingly, the spatial frequency of the second ribs 9 is less than the spatial frequency of the first ribs 6 by approximately a factor of L/D.

Also, the spatial frequency of the second ribs 9 of a given second subgrid element 8 differs from the spatial frequency of the first ribs 6 of a corresponding first subgrid element 5, because the second subgrid elements 8 have a second predetermined number, n+m, (rather than only the first predetermined number n) of second ribs 9 which are approximately equally spaced. Accordingly, the spacing of a particular second subgrid element 8 is $(L/D)\cdot\{n/(n+m)\}$ times the spacing of its corresponding first subgrid element 5.

Figure 5A:
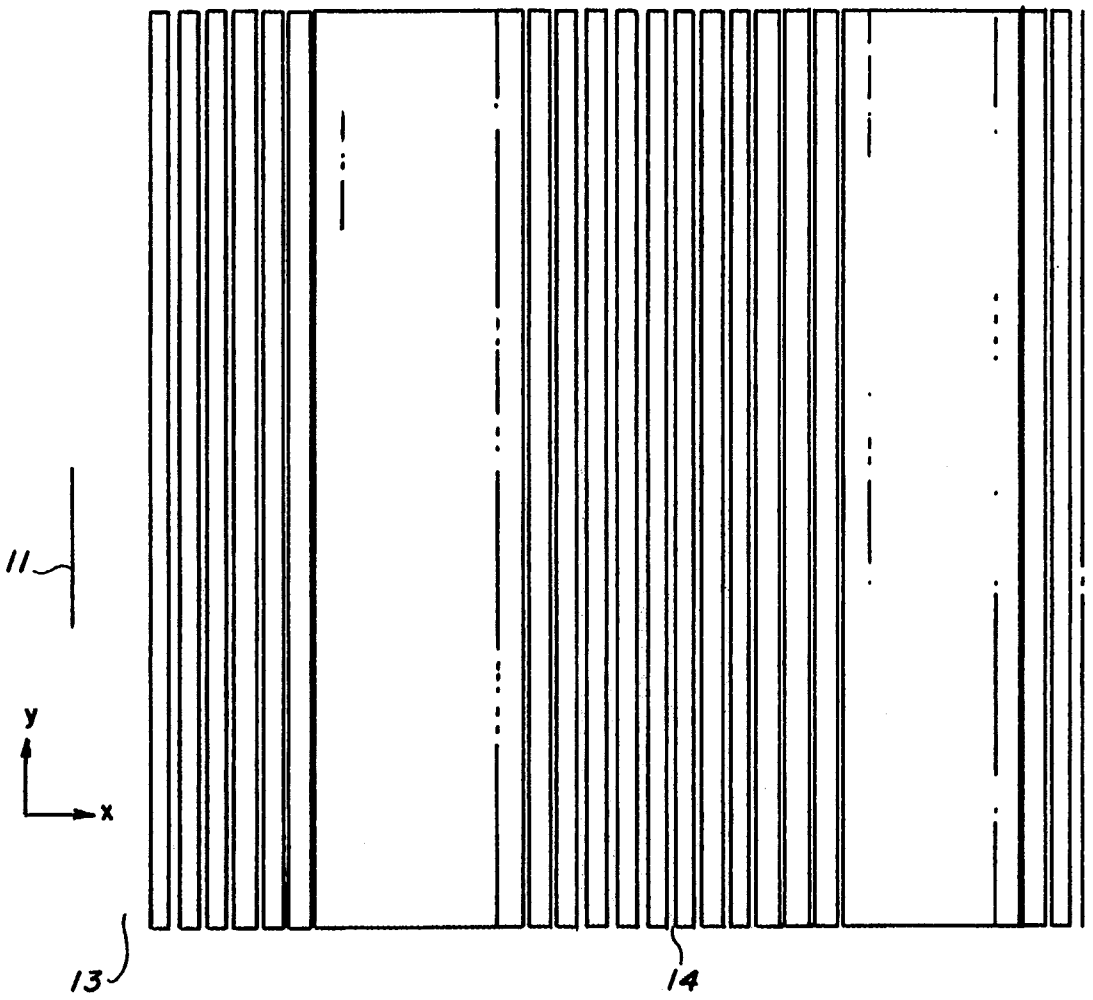
FIG. 5A is a Moiré or fringe pattern generated by a subgrid system of the apparatus of the claimed invention.

The integer m is typically one or two and defines the number of maxima (i.e., the number of peak amplitudes) of an intensity pattern derived from a particular subgrid system. The photons from the source 1 which pass through each subgrid system generate an intensity pattern for each subgrid system which is referred to as a 'Moiré' or 'fringe pattern'. FIG. 5A is a Moiré or fringe pattern resulting from a subgrid system oriented in the y direction and having a particular spatial frequency. By measuring the peak amplitude (or maxima) of the intensity pattern and the phase (i.e., the point at which a maximum occurs relative to a reference system such as that provided by a fiducial mark 11 provided near one of the first subgrid elements 5 or second subgrid elements 8 which is projected onto a detector plane), the amplitude and phase of the Fourier component associated with a given subgrid system can be determined. Therefore, each subgrid system can be used to determine the orientation, spatial frequency, amplitude and phase of its associated Fourier component. The array of Fourier components derived for all of the subgrid systems is termed an image of the radiation intensity distribution of the source in spatial frequency domain.

Figure 5B:
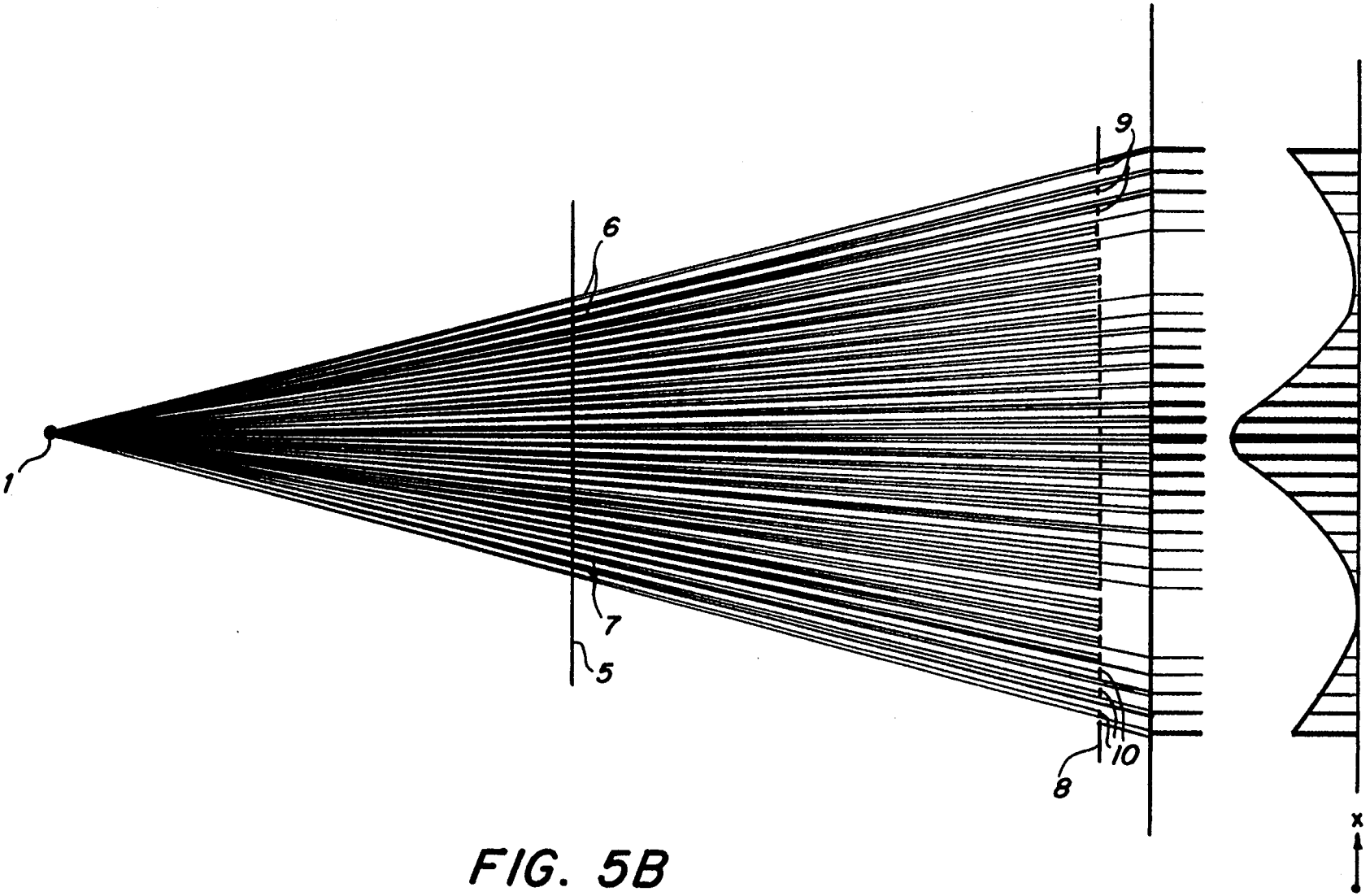
FIG. 5B is a section of the Moiré or fringe pattern of FIG. 5A along the x-direction of FIG. 5A.

FIG. 5B indicates the Moiré or fringe pattern which is essentially a section of the Moiré or fringe pattern in FIG. 5A taken along the x-direction in FIG. 5A. Incidentally, in FIGS. 5A and 5B, because the first ribs 6 and the and the first radiation-transparent regions 7 are equally-spaced, and because the second ribs 9 and the second radiation-transparent regions 10 are equally-spaced, the overall throughput of the radiation passing through the subgrid systems is 25% of its incident value. Throughput can be adjusted by varying the widths of the first ribs 6 and the second ribs 9 relative to the first radiation-transparent regions 7 and the second radiation-transparent regions 10, respectively.

To measure the amplitude and phase of the Fourier component for each subgrid system, a position-sensitive detector 12 is provided in the detector plane which is approximately parallel to the source plane and the planes defined by the first grid 3 and the second grid 4. The position-sensitive detector 12 includes detector elements (not shown) which correspond to each subgrid system. Each detector element can be realized variously such as by using a portion of a photographic film, by using a series of photodiodes or by using a single photodiode which is scanned across the Moiré or fringe pattern for a given subgrid system. The detector elements can also be realized using a charge-coupled device, a microchannel plate system or a silicon-based position sensor, for example. Significantly, the detector element is only required to have sufficient sensitivity to detect the wavelength of the Moiré or fringe pattern for a given subgrid system, and is not required to have a resolution or sensitivity as fine as the smallest spacings of the first ribs 6 of the first subgrid elements 5 or the second ribs 9 of the second subgrid elements 8. This feature is particularly important because, whereas the spacings of the first ribs 6 or second ribs 9 of a given subgrid system can be spaced by a few microns using present lithographic techniques, detector elements having resolutions of a few microns cannot be readily manufactured at present. Referring again to FIG. 5A, it is preferred that each detector element of the position-sensitive detector 12 be sufficiently sensitive to measure the intensity at intervals about one-tenth of the distance between first maximum 13 and second maximum 14. Accordingly, the detector element(s) with the most severe sensitivity requirement should be able to measure one-tenth of the distance between the first maximum 13 and second maximum 14 of the Moiré or fringe pattern(s) generated by the subgrid system(s) which has the finest spacings of first ribs 6 and second ribs 9.

As previously mentioned, the spatial frequency of the Fourier component measured by a particular subgrid system is predetermined by the spacing of the first ribs 6 (i.e., the spatial frequency in $cm^{-1}$ is equal to one divided by the rib spacing in cm) for that particular subgrid system. Also, the angular orientation of the Fourier component to be measured by a subgrid system is predetermined by, and is the same as, the angular orientation of the first ribs 6 and the second ribs 9 of a given subgrid system. The amplitude and phase of each Fourier component measured by each subgrid system can be determined by the detector elements associated with each subgrid system. The array of amplitudes, phases, spatial frequencies and angular orientations of the Fourier components of all subgrid systems in the apparatus are collectively referred to as the image of the radiation intensity distribution of the source in spatial frequency domain.

The number of subgrid systems required to generate an image of the radiation intensity distribution from the source 1, depends upon the complexity of the radiation intensity distribution of the source 1. The maximum number of subgrid systems which might be required is equal to one-half of the number of image pixels to be generated because each subgrid system measures two quantities, an amplitude and a phase of the associated Fourier component, and hence, the subgrid systems can be used to determine 2N image pixels. If characteristics such as the spatial frequencies and/or angular orientions of the radiation intensity distribution of the source 1 are known (as is often the case), this information can be exploited to reduce the number of subgrid systems used. For example, if a bright portion of the image contains N bright points or pixels, then the positions and intensities of those N bright points can be determined with about N subgrid systems. Alternatively, if a fraction f of the image is bright and the remainder is dark, the number of subgrid systems can be reduced by a factor of f from the maximum amount described above. Further, if a particular spatial component is known to have most of the information of interest, as when the source 1 has a pattern of regularly-spaced stripes of a particular angular orientation, a single subgrid system could be sufficient.

An important feature of the Fourier transform microscope 2 is its magnification M which derives from the use of the first grid 3 and the second grid 4. The first subgrid elements 5 with the finest spacing of first ribs 6, are used to derive a Fourier component of the image of the radiation intensity distribution of the source 1, which has a wavelength $\lambda_{min}$ (or, i.e., a spatial frequency) and an angular orientation which corresponds to that of the first ribs 6 in the particular first subgrid elements 5. A pattern generated by one of the first subgrid elements 5 with the finest spacing and projected onto the plane of the second grid 4, has a wavelength that is $\lambda_{min}$ enlarged by the factor $r=L/D$. The factor r is relatively small so that magnification attributable to the factor $r=L/D$ is also relatively small. However, use of the second subgrid elements 8 corresponding to the first subgrid elements 5, produces a much coarser Moiré or fringe pattern on a scale of a second subgrid element width, W, divided by the number of fringes m. By measuring the amplitude and phase of the coarser Moiré or fringe pattern, the amplitude and spacing of the finer pattern produced by the first grid element 5 with the finest spacing can be determined. The magnification provided by a subgrid system is equal to $W/(m \cdot \lambda_{min})$.

Using a Fourier transform, the image in spatial frequency domain can be converted to an image in spatial domain by employing a processor 15. If the position-sensitive detector 12 is realized so that it has an analog output (e.g., as would be the case with a photographic film), the analog output is converted into a digital signal using a digitizer 16, and the digital signal is provided to the processor 15 coupled to the digitizer 16. The digitizer 16 can be realized as a microdensitometer, for example; Otherwise, if the position-sensitive detector 12 has a digital output, the position-sensitive detector 12 can be coupled directly to the processor 15, so that the digital signal is provided directly thereto. Accordingly, because the digitizer 16 is an optional element which is provided in dependency upon the particular realization of the position-sensitive detector 12, the digitizer 16 is illustrated in a broken line in FIG. 1.

Figure 6:
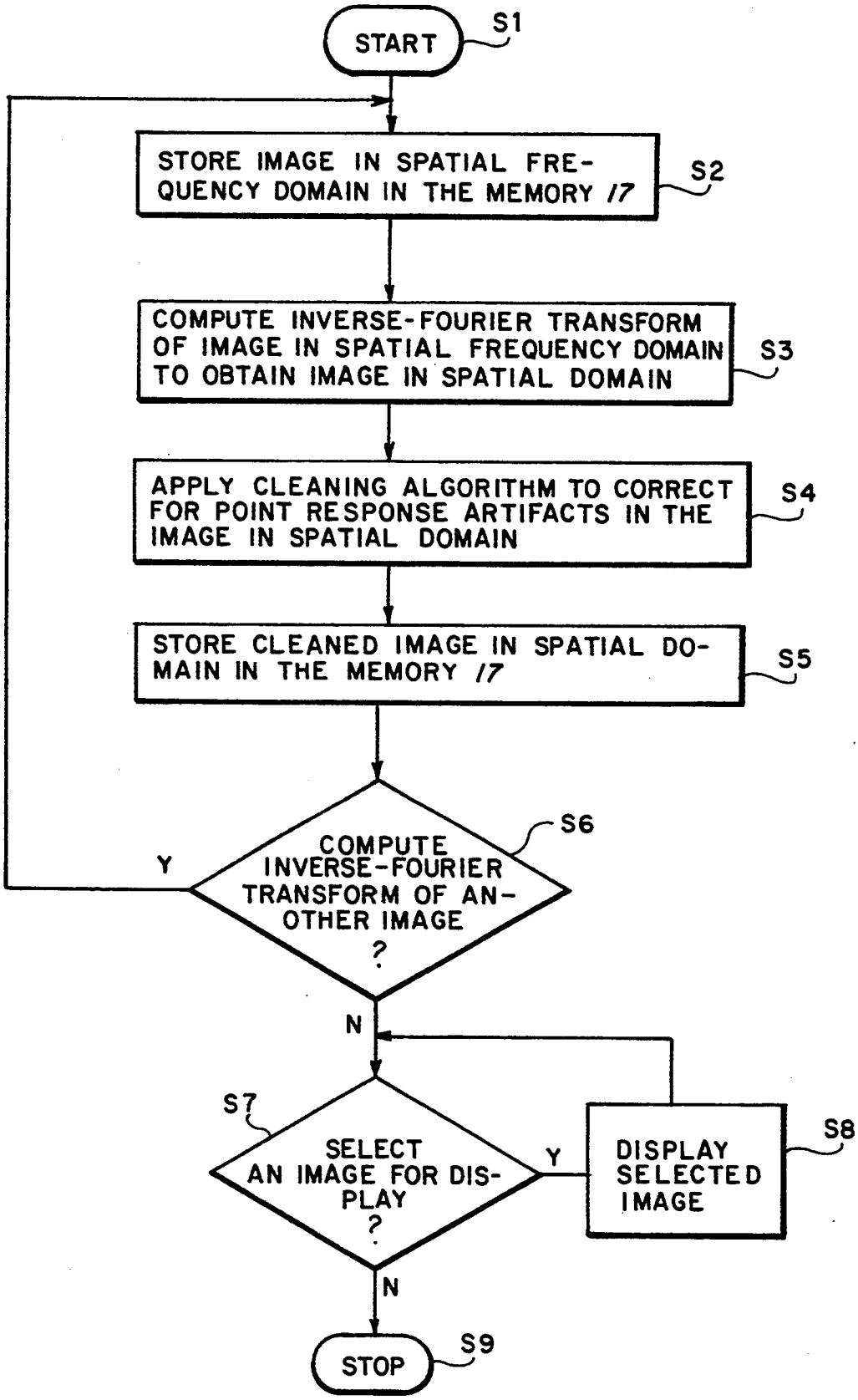
FIG. 6 is a flowchart of processing implemented by a processor of the apparatus in accordance with the claimed invention.

In any case, using a control program stored in a memory 17 coupled to the processor 15, the processor 15 can perform a Fourier transform on the digital signal of the image in spatial frequency domain to generate a digital signal of the image in spatial domain. Referring to FIG. 6, a flowchart of the processing employed by the processor 15 begins in step S1. In step S2, the processor 15 stores the image of the radiation intensity distribution of the source 1 in spatial frequency domain received from the position-sensitive detector 12 (via the digitizer 16, if applicable) in the memory 17. In step S3, the processor 15 calculates the inverse-Fourier transform of the image of the radiation intensity distribution of the source 1 to obtain an image of the radiation intensity distribution of the source 1 in spatial domain. The control program employed by the processor 15 can be a commercially available software package such as Astronomical Image Processing System ("AIPS") produced by the National Radio Astronomy Observatory in Charlottesville, Va., although persons of ordinary skill in the art can design a software package to perform the above processing.

After obtaining the image of the radiation intensity distribution of the source 1 in spatial domain, the processor 15 applies a 'cleaning' algorithm to the image in spatial domain to remove point response artifacts in step S4 (the cleaning algorithm is available as an option in the AIPS software package). That is, the processor 15 applies the cleaning algorithm to remove the affects of using discrete spatial frequencies, angular orientations, amplitudes and phases for the Fourier components (rather than a continuum of these quantities) which represent the image of the radiation intensity distribution of the source 1 in spatial frequency domain.

In step S5, the processor 15 stores the cleaned image in spatial domain in the memory 17. In Step S6, the processor 15 determines whether an inverse-Fourier transform is to be computed for another image in spatial frequency domain. If so, steps S2 through S6 are repeated. On the other hand, if the result in the determination of step S6 is negative, the processor 15 determines whether any image stored in the memory 17 is selected by a user for display on a display unit 18. If so, the processor 15 provides the image from the memory 17 to the display unit 18 (which can be realized as a cathode-ray tube or liquid-crystal display or the like) for display, and control returns to step S7. On the other hand, if the result of the determination in step S7 is negative, processing by the processor 15 terminates in step S9.

Figure 7:
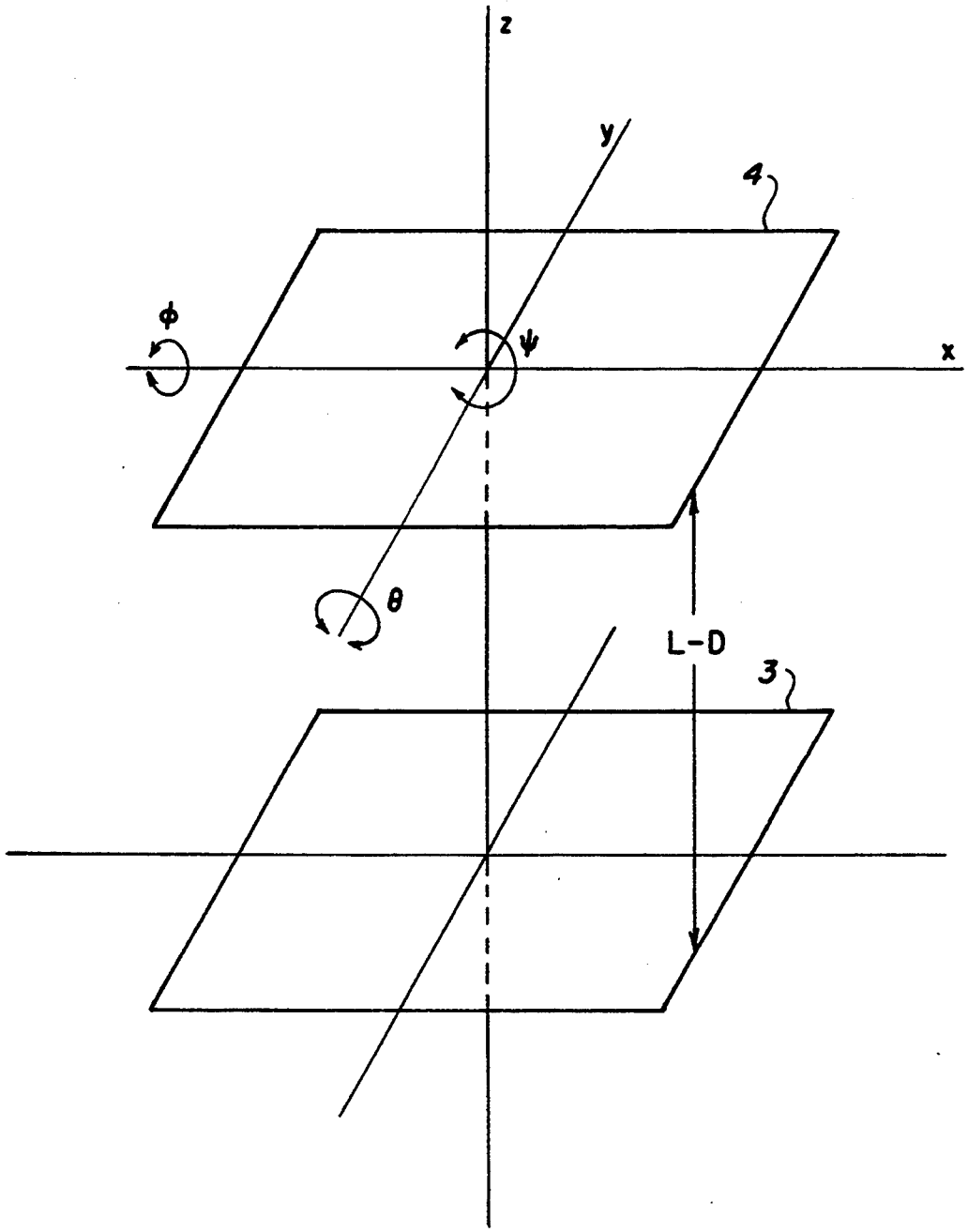
FIG. 7 is a diagram illustrating conditions for alignment of the first and second grids of the apparatus of the claimed invention.

To operate properly, the first grid 3 and the second grid 4 must be aligned correctly. In FIG. 7, the first grid 3 and the second grid 4 each have six degrees of freedom. For example, as shown in FIG. 4, the second grid 4 can be translated along the x-, y-, or z-axes, or can be rotated by angles $\phi$, $\theta$ or $\psi$ about the x-, y- or z-axes, respectively. Because the second subgrid elements 8 are required to have a common field of view with corresponding first subgrid elements 5, and because the first ribs 6 and the second ribs 9 must have approximately the same angular orientation, alignment in the x-, y- and $\psi$-directions is particularly important whereas alignment in the z-, $\phi$-and $\theta$-directions is less important.

To attain an aligned condition, referring to FIG. 2, the first grid 3 includes first grid fiducial marks 19. Likewise, referring to FIG. 4, the second grid 4 includes second grid fiducial marks 20. Accordingly, by arranging a point small light source (i.e., a small light source) at the distance at which the source i is to be located, the first grid fiducial marks 19 cast a shadow which should coincide With the second grid fiducial marks 20. By manipulating the translational and/or rotational position of the first grid 3 or the second grid 4 by adjusting first and second grid holders (not shown), respectively, the first grid 3 can be properly aligned with the second grid 4.

Alternatively, the first grid 3 and the second grid 4 can be provided with a Fresnel zone plate 21, respectively. The Fresnel zone plate 21 can be used to align the first grid 3 and the second grid 4. Alignment techniques using Fresnel zone plates are well-known to those of ordinary skill in the art. Also, other alignment devices and techniques will occur to those of ordinary skill in the art.

In operation, the first grid 3 and the second grid 4 are aligned, and the Fourier transform microscope 2 is arranged in proximity to the source 1 to receive radiation therefrom. The radiation passes through the first subgrid elements 5 of the first grid 3 and the corresponding second subgrid elements 8 of the second grid 4 to generate an array of Moiré or fringe patterns. The position-sensitive detector 12 detects the amplitude and phase from each Moiré or fringe pattern to determine the amplitude and phase of the Fourier component associated with each subgrid system, and generates a signal indicative of the image of the radiation intensity distribution of the source 1 in spatial frequency domain (as previously explained, the image in spatial frequency domain is the array of all amplitudes, phases, spatial frequencies and angular orientations of the Fourier components of all subgrid systems). The image in spatial frequency domain can be obtained from the signal from the position-sensitive detector 12 and stored in the memory 17 under control of the processor 15. Using a control program stored in the memory 17, the processor 15 can perform a Fourier transform on the image in spatial frequency domain to obtain the image of the radiation intensity distribution of the source 1 in spatial domain. The image in spatial domain can be stored in the memory 17 under control of the processor 15. Also, using a control program stored in the memory 17, the processor 15 can apply the cleaning algorithm to reduce the point response artifacts caused by the fact that each subgrid system detects discrete amplitudes and phases of the Fourier components as opposed to a continuum of these quantities. The cleaned image in spatial domain can be-stored in the memory 17 under control of the processor 15. Under control of the processor 15, additional images can be obtained from the position-sensitive detector 12 and stored in the memory 17. Also under control of the processor 15, the image in spatial frequency domain, the image in spatial domain or other images stored in the memory 17, for example, can be displayed on the display unit 18.

Several alternative embodiments of the claimed invention as described above can be realized. For example, although the first subgrid elements 5 of the first grid 3 and the second subgrid elements 8 of the second grid 4 have two-dimensional arrangements in FIGS. 2 and 4, respectively, the first subgrid elements 5 and the second subgrid elements 8 could as well have a one-dimensional arrangement including one row or one column of the first subgrid elements 5 and the second subgrid elements 8. Also, the claimed invention can be adapted to perform imaging of a source 1 in three-dimensions by moving the Fourier transform microscope 2 nearer to or farther from (i.e., along its z-axis) the source 1 to image at different depths in the source 1. Also, by obtaining a time-series or continuum of images (such as a streak pattern generated on a moving photographic film, for example) using a one-, two- or three- dimensional Fourier transform microscope 2, changes in spatial frequencies, angular orientations, phases and amplitudes can be observed over time in the radiation of interest. Further, each subgrid system can be used to extract the amplitude and phase for more than one Fourier component by overlaying first ribs 6 with different spatial frequencies and/or angular orientation, and by providing corresponding second ribs 9, although throughput of the radiation of interest will be reduced when this is done.

The many features and advantages of the present invention are apparent from the detailed specification and thus it is intended by the appended claims to cover all such features and advantages of the invention which follow in the true spirit and scope thereof. Further, since numerous modifications and changes will readily occur to those skilled in the art, it is not desired to limit the invention to the exact construction and operation illustrated and described, and accordingly all suitable modifications and equivalents may be resorted to as falling within the scope of the invention.

What is claimed is:

1. An apparatus for imaging a source of radiation, comprising:

a first grid operatively arrangable in proximity to the source, having at least one first subgrid element having approximately parallel, equally-spaced linear first ribs including a material opaque to the radiation, and having first radiation-transparent regions alternating with the first ribs, which are transparent to the radiation; and a second grid operatively arranged in proximity to the first grid, having at least one second subgrid element corresponding to the at least one first subgrid element and which is larger than the at least one first subgrid element, the at least one second subgrid element having second ribs which are approximately parallel, equally-spaced linear second ribs including a material opaque to the radiation, and having second radiation-transparent regions alternating with the second ribs, which are transparent to the radiation;

wherein each at least one first subgrid element and its corresponding at least one second subgrid element define a subgrid system, and wherein a spacing of the first ribs defines a spatial frequency of a Fourier component of the radiation detected by the subgrid system.

2. An apparatus for imaging a source of radiation, comprising:

a first grid operatively arrangable in proximity to the source, having at least one first subgrid element having approximately parallel, equally-spaced linear first ribs including a material opaque to the radiation, and having first radiation-transparent regions alternating with the first ribs, which are transparent to the radiation; and a second grid operatively arranged in proximity to the first grid, having at least one second subgrid element corresponding to the at least one first subgrid element and which is larger than the at least one first subgrid element, the at least one second subgrid element having second ribs which are approximately parallel, equally-spaced linear second ribs including a material opaque to the radiation, and having second radiation-transparent regions alternating with the second ribs, which are transparent to the radiation;

wherein each at least one first subgrid element and its corresponding at least one second subgrid element define a subgrid system, and wherein an angular orientation of the first and second ribs relative to a reference coordinate system defines an angular orientation of a Fourier component of the radiation detected by the subgrid system.

3. An apparatus for imaging a source of radiation, comprising:

a first grid operatively arrangable in proximity to the source, having at least one first subgrid element having approximately parallel, equally-spaced linear first ribs including a material opaque to the radiation, and having first radiation-transparent regions alternating with the first ribs, which are transparent to the radiation; and a second grid operatively arranged in proximity to the first grid, having at least one second subgrid element corresponding to the at least one first subgrid element and which is larger than the at least one first subgrid element, the at least one second subgrid element having second ribs which are approximately parallel, equally-spaced linear second ribs including a material opaque to the radiation, and having second radiation-transparent regions alternating with the second ribs, which are transparent to the radiation;

wherein each at least one first subgrid element and its corresponding at least one second subgrid element define a subgrid system, further comprising:

a position-sensitive detector operatively arranged in proximity to the second grid, having at least one detector element for receiving the radiation which passes through the subgrid system, and for generating a signal based on the radiation which passes through the subgrid system;

wherein the signal indicates an amplitude of a Fourier component detected by the subgrid system.

4. An apparatus for imaging a source of radiation, comprising:

a first grid operatively arrangable in proximity to the source, having at least one first subgrid element having approximately parallel, equally-spaced linear first ribs including a material opaque to the radiation, and having first radiation-transparent regions alternating with the first ribs, which are transparent to the radiation; and a second grid operatively arranged in proximity to the first grid, having at least one second subgrid element corresponding to the at least one first subgrid element and which is larger than the at least one first subgrid element, the at least one second subgrid element having second ribs which are approximately parallel, equally-spaced linear second ribs including a material opaque to the radiation, and having second radiation-transparent regions alternating with the second ribs, which are transparent to the radiation;

wherein each at least one first subgrid element and its corresponding at least one second subgrid element define a subgrid system, further comprising:

a position-sensitive detector operatively arranged in proximity to the second grid, having at least one detector element for receiving the radiation which passes through the subgrid system, and for generating a signal based on the radiation which passes through the subgrid system;

wherein the signal indicates a phase of a Fourier component detected by the subgrid system.

5. An apparatus for imaging a source of radiation, comprising:

a first grid operatively arrangable in proximity to the source, having at least one first subgrid element having approximately parallel, equally-spaced linear first ribs including a material opaque to the radiation, and having first radiation-transparent regions alternating with the first ribs, which are transparent to the radiation; and a second grid operatively arranged in proximity to the first grid, having at least one second subgrid element corresponding to the at least one first subgrid element and which is larger than the at least one first subgrid element, the at least one second subgrid element having second ribs which are approximately parallel, equally-spaced linear second ribs including a material opaque to the radiation, and having second radiation-transparent regions alternating with the second ribs, which are transparent to the radiation;

wherein each at least one first subgrid element and its corresponding at least one second subgrid element define a subgrid system, further comprising:

a position-sensitive detector operatively arranged in proximity to the second grid, having at least one detector element for receiving the radiation which passes through the subgrid system, and for generating a signal based on the radiation which passes through the subgrid system;

wherein the signal indicates an image of the radiation intensity distribution of the source in spatial frequency domain, further comprising:

a processor operatively coupled to receive the signal, for computing an image of the radiation intensity distribution of the source in spatial domain from the image of the radiation intensity distribution indicated by the signal.

6. An apparatus as claimed in claim 5, further comprising:

a memory operatively coupled to the processor, for storing at least one of the image in spatial frequency domain and the image in spatial domain.

7. An apparatus as claimed in claim 5, further comprising:

a display unit operatively coupled to the processor, for displaying at least one of the image in spatial frequency domain and the image in spatial domain.

8. An apparatus for imaging a source of radiation, comprising:

a first grid operatively arrangable in proximity to the source, having at least one first subgrid element having approximately parallel, equally-spaced linear first ribs including a material opaque to the radiation, and having first radiation-transparent regions alternating with the first ribs, which are transparent to the radiation; and a second grid operatively arranged in proximity to the first grid, having at least one second subgrid element corresponding to the at least one first subgrid element and which is larger than the at least one first subgrid element, the at least one second subgrid element having second ribs which are approximately parallel, equally-spaced linear second ribs including a material opaque to the radiation, and having second radiation-transparent regions alternating with the second ribs, which are transparent to the radiation;

wherein the first and second grids are for use in generating an image of a radiation intensity distribution of the source in spatial frequency domain which can be Fourier-transformed into an image of a radiation intensity distribution in spatial domain having a predetermined spatial resolution, a spacing of the first ribs of the at least first subgrid element which has a smallest rib spacing being spaced by approximately twice the predetermined spatial resolution.

9. An apparatus as claimed in claim 8, wherein an average energy of the radiation is greater than or equal to two kiloelectron-volts (keV).

10. An apparatus for imaging a source of radiation, comprising:

a first grid operatively arrangable in proximity to the source, having at least one first subgrid element having approximately parallel, equally-spaced linear first ribs including a material opaque to the radiations and having first radiation-transparent regions alternating with the first ribs which are transparent to the radiation; and a second grid operatively arranged in proximity to the first grid, having at least one second subgrid element corresponding to the at least one first subgrid element and which is larger than the at least one first subgrid element, the at least one second subgrid element having second ribs which are approximately parallel, equally-spaced linear second ribs including a material opaque to the radiation, and having second radiation-transparent regions alternating with the second ribs, which are transparent to the radiation;

wherein the first grid includes silicon;

wherein the first radiation-transparent regions are formed by making a thickness of the silicon in the at least one first subgrid element sufficiently thin to produce translucency to the radiation.

11. An apparatus for imaging a source of radiation, comprising:

a first grid operatively arrangable in proximity to the source, having at least one first subgrid element having approximately parallel, equally-spaced linear first ribs including a material opaque to the radiation, and having first radiation-transparent regions alternating with the first ribs, which are transparent to the radiation; and a second grid operatively arranged in proximity to the first grid, having at least one second subgrid element corresponding to the at least one first subgrid element and which is larger than the at least one first subgrid element, the at least one second subgrid element having second ribs which are approximately parallel, equally-spaced linear second ribs including a material opaque to the radiations, and having second radiation-transparent regions alternating with the second ribs, which are transparent to the radiation;

wherein the at least one first subgrid has a first predetermined number n of first ribs, n being a positive integer, and the at least one second subgrid has a second predetermined number n+m of second ribs, m being a positive integer;

wherein a distance from the source to the first grid is D, and a distance from the source to the second grid is L, and the second ribs are spaced by a factor of $(L/D)\cdot\{n/(n+m)\}$ times a spacing of the first ribs.

12. An apparatus for imaging a source of radiation, comprising:

a first grid operatively arrangable in proximity to the source, having at least one first subgrid element having approximately parallel, equally-spaced linear first ribs including a material opaque to the radiation, and having first radiation-transparent regions alternating with the first ribs, which are transparent to the radiation; and a second grid operatively arranged in proximity to the first grid, having at least one second subgrid element corresponding to the at least one first subgrid element and which is larger than the at least one first subgrid element, the at least one second subgrid element having second ribs which are approximately parallel, equally-spaced linear second ribs including a material opaque to the radiation, and having second radiation-transparent regions alternating with the second ribs, which are transparent to the radiation;

wherein the first grid includes a first Fresnel zone plate which is operatively adapted to align the first and second grids.

13. An apparatus for imaging a source of radiation, comprising:

a first grid operatively arrangable in proximity to the source, having at least one first subgrid element having approximately parallel, equally-spaced linear first ribs including a material opaque to the radiation, and having first radiation-transparent regions alternating with the first ribs, which are transparent to the radiation; and a second grid operatively arranged in proximity to the first grid, having at least one second subgrid element corresponding to the at least one first subgrid element and which is larger than the at least one first subgrid element, the at least one second subgrid element having second ribs which are approximately parallel, equally-spaced linear second ribs including a material opaque to the radiation, and having second radiation-transparent regions alternating with the second ribs, which are transparent to the radiation;

wherein a spacing $d_1$ of the first ribs satisfies a relationship $d_1^2 > \lambda\cdot L/2$, in which $\lambda$ is a longest wavelength of the radiation, and L is a distance from the source to the second grid.

14. An apparatus for imaging a source of radiation, comprising:

a first grid operatively arrangable in proximity to the source, having at least one first subgrid element which has approximately parallel, equally-spaced first ribs including a material opaque to the radiation, and having first radiation-transparent regions alternating with the first ribs, which are transparent to the radiation, the at least one first subgrid element being effective to cause the generating of an image of a radiation intensity distribution of the source in spatial frequency domain which can be Fourier-transformed into an image of a radiation intensity distribution in spatial domain having a predetermined spatial resolution, a spacing of the first ribs of the at least first subgrid element which has a smallest rib spacing being spaced by approximately twice the predetermined spatial resolution.

* * * * *